United States Patent [19]

Edström

[11] 4,349,189

[45] Sep. 14, 1982

[54] MODULE FOR PICKING, TRANSPORTATION AND DEPOSITING OF SHEETED OR FOLDED MATERIAL

[75] Inventor: Lars G. Edström, Stockholm, Sweden

[73] Assignee: Malmöhus Invest AB, Malmö, Sweden

[21] Appl. No.: 9,953

[22] Filed: Feb. 6, 1979

[30] Foreign Application Priority Data

| | | | |
|---|---|---|---|
| Feb. 7, 1978 | [SE] | Sweden | 7801396 |
| Feb. 7, 1978 | [SE] | Sweden | 7801397 |
| Feb. 7, 1978 | [SE] | Sweden | 7801398 |
| Feb. 7, 1978 | [SE] | Sweden | 7801399 |
| Jun. 15, 1978 | [SE] | Sweden | 7806910 |

[51] Int. Cl.[3] ..... B65H 9/16; B65H 5/16

[52] U.S. Cl. ..... 271/251; 198/456; 198/583; 271/271

[58] Field of Search ..... 271/251, 250, 275, 184, 271/271, 225, 248; 198/583, 817, 456; 270/58

[56] References Cited

U.S. PATENT DOCUMENTS

| | | | |
|---|---|---|---|
| 767,162 | 8/1904 | McNear | 198/583 |
| 1,353,088 | 9/1920 | Swift | 271/251 |
| 2,702,189 | 2/1955 | Zugel et al. | 270/58 |
| 2,986,393 | 5/1961 | Brigham | 271/271 X |
| 3,866,906 | 2/1975 | Berry | 271/250 X |
| 4,046,248 | 9/1977 | Goffredo et al. | 198/583 |
| 4,170,348 | 10/1979 | Hoeink et al. | 271/271 X |

FOREIGN PATENT DOCUMENTS

| | | | |
|---|---|---|---|
| 1083295 | 9/1967 | United Kingdom | 271/248 |

*Primary Examiner*—Bruce H. Stoner, Jr.
*Attorney, Agent, or Firm*—Frishauf, Holtz, Goodman & Woodward

[57] ABSTRACT

Apparatus for picking, transportation and depositing of sheeted and/or folded material from different bundles or bunches of material comprises a conveyor module for transport and registration of the sheeted material, the conveyor module including a control device for controlling and registering the material to be transported by the conveyor in a desired direction of transport, at least one conveyor belt, chain or the like driving the material along the conveyor module, a motor coupled to drive the at least one belt, chain or the like, the direction of travel of the belt, chain or the like being placed at a sharp angle in relation to the control device. Also disclosed is an inserter which can pick different sheets of material by means of suction from a raised or a lying position and to transport the sheets in a desired position, such as on the conveyor. Still further, apparatus and a method of calibration and adjustment of the inserter is provided.

5 Claims, 13 Drawing Figures

MODULE FOR PICKING, TRANSPORTATION AND DEPOSITING OF SHEETED OR FOLDED MATERIAL

BACKGROUND OF THE INVENTION

This invention relates to a module for picking, transportation and depositing of sheeted and/or folded material from different bundles or bunches of such material on top of one another to form sets or bundles of such material.

Prior art devices of this or related kind of devices are, for example, shown in or disclosed by U.S. Pat. Nos. 928,365; 999,515; 2,406,766; 3,218,061; 3,329,253; and 3,391,924; in GB Pat. Nos. 1,429,887 and 1,488,879; and in German Pat. Nos. 182,765 and 943,774.

SUMMARY OF THE INVENTION

One feature of this invention is the provision of a conveyor module for transport and registration of sheeted or folded material.

A second feature of the invention is the provision of a module for picking and depositing sheeted or folded material on top of one other to form a set or a bundle such that a combined machine of independently acting modules is obtained, which modules can be provided in optional numbers. Said modules easily can be put together to adapt the combined machine to the number of sheets desired in each set of material.

Another feature of the invention is the provision of an inserter, which can pick different sheets of material by means of suction, for example, from a raised or erected and/or lying position, and to transport to and deposit such sheets in the position desired, preferably in the conveyor part of a module.

A fourth feature of the invention is a method for calibration and adjustment of an inserter working with air suction for picking a sheeted or folded material one at a time from a bunch or bundle of material.

A fifth feature of the invention is a modified type of inserter where the movement is divided into two parts in order to speed up the inserter work and makes it possible—in the same module—to pick, transport and deposite both lying and raised or erected sheets.

DETAILED DESCRIPTION

Figure 1:
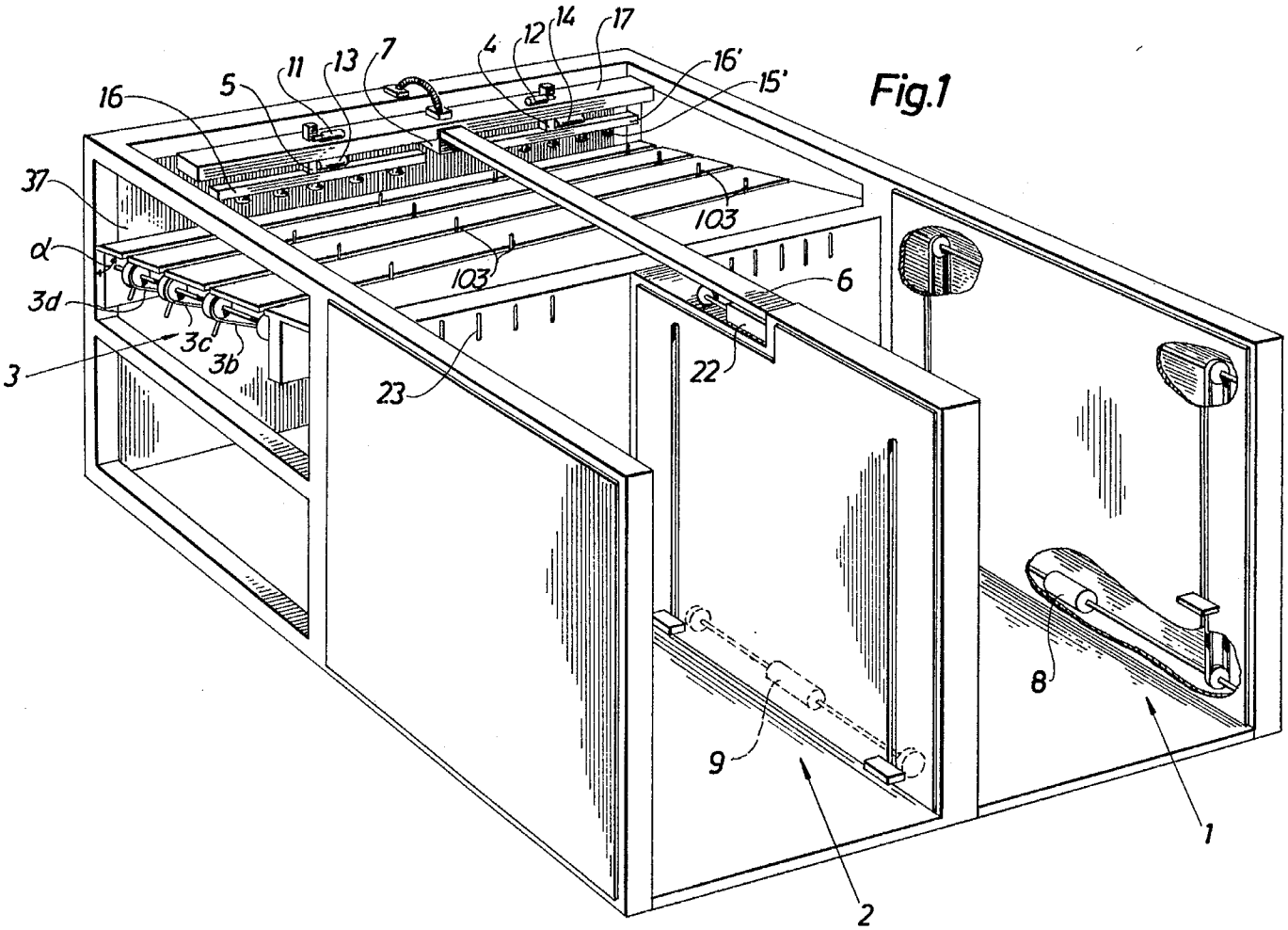
FIG. 1 shows a perspective view of a module.
Figure 2:
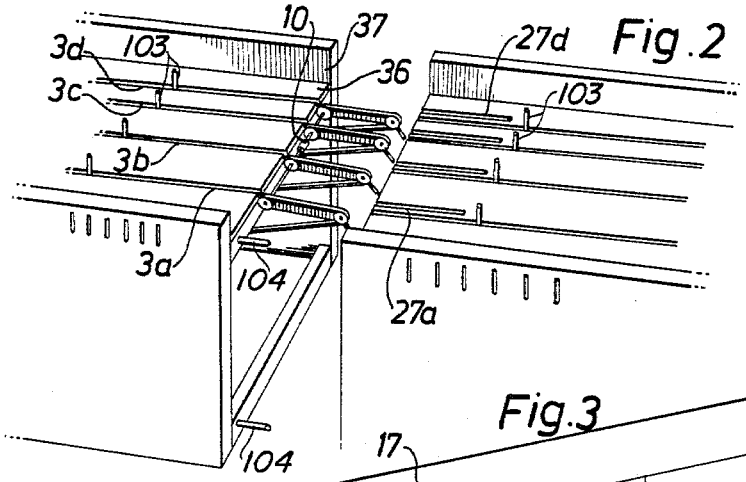
FIG. 2 shows a perspective view of the end sections of two adjacently arranged modules.

The picking machine for sheeted material described hereinafter comprises an arbitrary number of easily assembled and interconnectable modules, each of which is entirely self-supplying. Each module is controlled by a central processing unit CPU-1 and by a microprocessor DMC-1 for each station in the module. DMC-1 in each station, shown in FIG. 7, comprises the actual core or heart of the picking machine and will be described in detail hereinafter. Each module includes—as is evident from FIG. 1—two hoists 1 and 2, into which bundles, for instance of paper sheets, are to be placed and from which bundles one sheet at a time is to be picked and deposited on a conveyor 3 running along one side of the hoists 1 and 2. As best seen in FIG. 2, the conveyor 3 comprises a plurality of mutually parallel-running belts 3*a*–3*d*, which are provided with drivers 103 that are aligned relative to each other. The transport surface of the conveyor is inclined slightly away from the hoists 1 and 2, as indicated by the angle $\alpha$ in FIG. 1. The belts 3*a*–3*d* have furthermore been given such a direction of rotation that the direction of rotation of each belt deviates slightly from the wanted direction of transport for the sheets. The purpose of this is, in the first instance, for the sheets to be directed to the side 37 of the conveyor located farthest away from the hoists 1 and 2 in order to align one side of the sheets in relation to one another. The said side 37 of the conveyor is appropriately so devised that when several sheets are piled on top of one another the corresponding edge of the uppermost sheet is directed downwards, thereby preventing the edges from being folded upwards. The conveyor belts 3*a*–3*d* appropriately comprise toothed belts, each and every one of which forms a closed loop, which are driven synchronously and preferably stepwise by a motor 10 located in one end of the module—as particularly evident from FIG. 2. The shaft which links the motor 10 with drive wheels to the belts 3*a*–3*d* is preferably made openable at some point to allow the conveyor of an adjacent module—as particularly evident from FIG. 2—to be interconnected with the conveyor in the first-mentioned module, thereby assuring synchronous operation of the module conveyors. Synchronization of the conveyors in the various modules can naturally be attained by some other means, for example by controlling the feed to the motors 10 for the different conveyors 3 in the modules.

As particularly evident from FIG. 2, each module is provided in its front end—viewed in the direction of transport—with a plurality of recesses 27*a*–27*d*, the locations and numbers of these recesses corresponding to the locations and numbers of the idler belts 3*a*–3*d* outside the other end of the module, thereby making it possible to allow the conveyor belts of two adjacent modules to run mutually parallel a short distance into the adjacent—viewed in the direction of transport—module and also enabling two modules and their conveyors to be interconnected mechanically as stated earlier. Also other control devices for example in the form of pins 104 on one side of the module and corresponding recesses in its other side permit reliable interconnection of adjacently disposed modules. Referring to FIG. 1, each hoist 1 and 2 is equipped with a separate motor 8 and 9 for individual drive of each hoist. Each motor, for example 8, drives a toothed wheel (not shown) which in turn drives an endless loop, an arrangement indicated sketchwise in FIG. 1 in the hoist 1. Each hoist is naturally also equipped with devices (not shown) to stop it in the correct position. In the side of the hoist 1 and 2 which is located closest to the conveyor 3 there are also a number of slots 23, designated blow holes, the purpose of which will be explained in greater detail below.

A guide rail 6 in each module runs over part of the hoists 1 and 2 and out over the conveyor 3, which guide rail 6 can in one or both ends be provided with a shock-absorbing device 22 which can be designed as a bellows which emerges in the above-mentioned blow holes 23. Instead, a separate high-speed pump can obviously achieve the required blowing—airing—of the sheets in the hoists 1 and 2. A beam 17 running perpendicular to and controlled by the guide rail 6 can be driven by for example a linear motor or by a pneumatically actuated piston rod.

Figure 4:
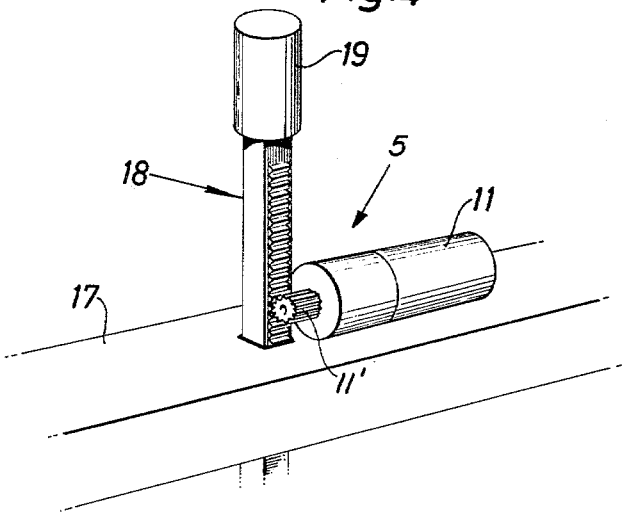
FIG. 4 shows a perspective view of a part of the inserter according to FIG. 3, FIGS. 5*a*–5*c* show different embodiments of the suction nozzles of the inserter according to FIG. 3.

As in FIG. 1, the beam 17 is equipped with a suction head 4, 5 for each hoist, i.e. it has one suction head on each side of the guide rail 6. As shown in FIG. 4, the neck 18 of each respective suction head 4 is vertically adjustable in relation to the beam 17 by means of a motor 11 having a toothed shaft 11' which engages with rack-like teeth of the neck 18. It should be noted that FIG. 4 only shows one neck and that corresponding parts must obviously also be provided at the other suction head 4. In the following description, only one suction head will be referred to and consequently it should be observed that the other suction head is similarly equipped.

As shown in FIG. 4, the suction head comprises an electrical air suction member 19, the speed and thus the capacity of which can be varied in a manner described in greater detail hereinafter. The air suction member 19 sucks air through the neck 18 of the suction head 5, which in the shown embodiment is made of a square-section pipe and which—as already mentioned—is provided at its outer end with teeth for meshing with the motor 11 to enable the neck 18 to be raised and lowered relative to the beam 17 (see FIG. 3). The neck 18 runs through the beam 17 and terminates with a solid end-piece 28, in the end of which a link 30 is slightly movable on a trunnion. This mobility or articulatability is limited by two stops 20, 21, disposed in the solid end-piece 28. The link 30 carries articulated in its turn a motor 13 and a suction head 16—as evident from FIG. 3—in such a manner that the suction head 16 can be turned approximately 180° when the motor 13 is driven. From the pipe-shaped part of the neck 18 and thus communicating with the air suction member 19 a flexible hose 29 runs down to the suction head 16, which comprises a square-section pipe with closed ends and which on its underside is equipped with nozzles 15*a*–15*e*.

Figure 5A:
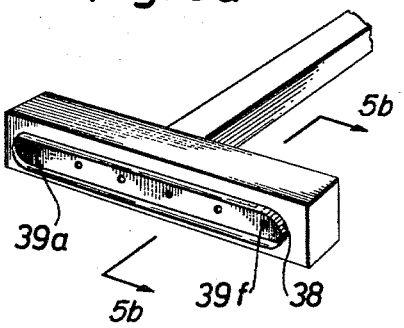
Figure 5B:
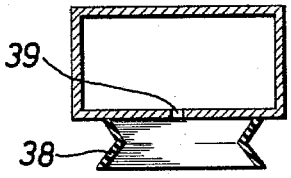
Figure 5C:
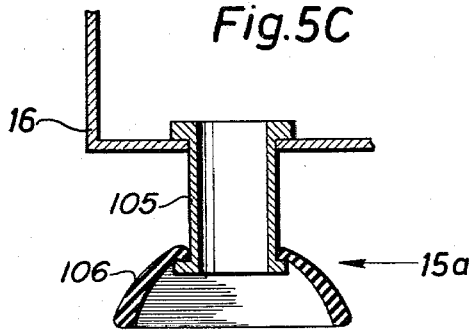

The said nozzles 15*a*–15*e*, one of which is shown in FIG. 5*c*, each comprise a pipe stump 105, fixed in a suitable manner in the square-section pipe 16, and a rubber cowl 106 placed on the end of the pipe stump. Instead, however, the underside of the suction head can be elaborated as shown in FIGS. 5*a* and 5*b* with a number of holes 39*a*–39*f*, appropriately positioned in a row, and an angular rubber moulding 38 surrounding the holes to provide a more effective action than with the embodiment according to FIG. 5*c*.

It is evident from the above that there is a direct communication between the air suction member 19 and each nozzle 15*a*–15*e* and since the speed and thus the capacity of the air suction member 19 is variable, the suction power of the nozzles 15*a*–15*e* against a sheet can also be varied, thereby enabling calibration and adjustment to be easily performed.

Figure 3:
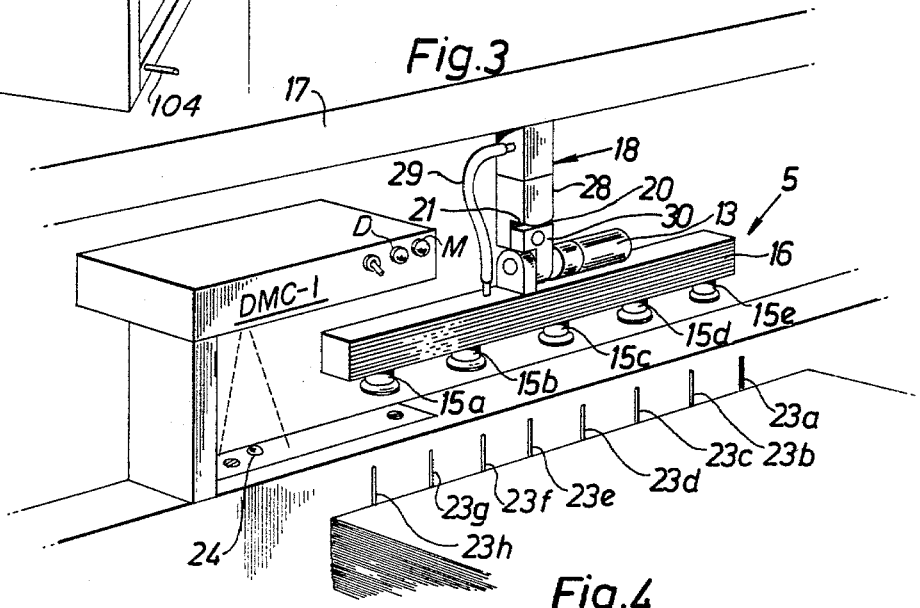
FIG. 3 shows a perspective view of an inserter.
Figure 7:
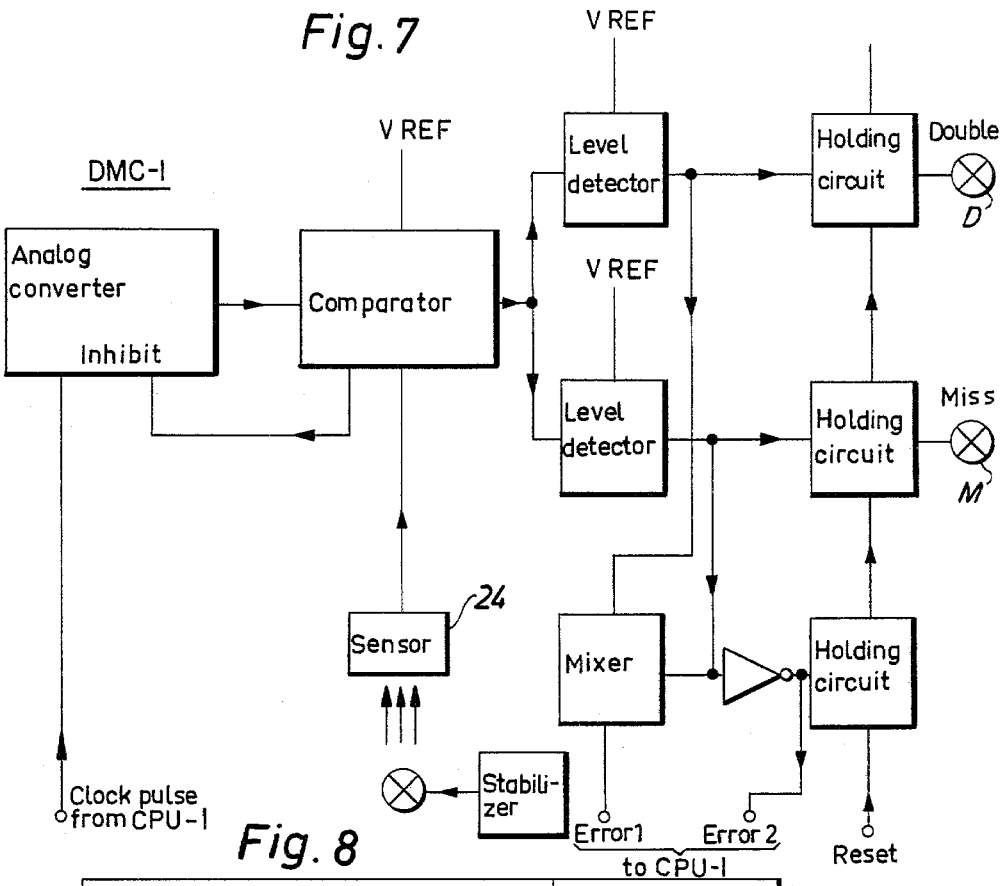
FIG. 7 shows a block diagram for the microprocessor (DMC-1) used in each station of each module.
Figure 8:
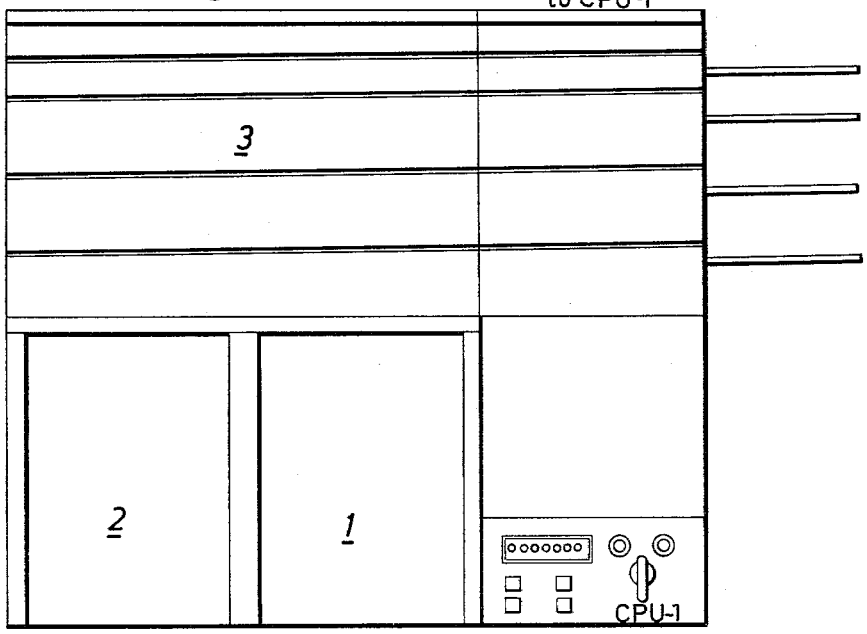
FIG. 8 shows a view from above of a module with a depositing section and appurtenant central processing unit.

The said calibration and adjustment can take place in the following manner. As shown in FIG. 3, a unit designated DMC-1 is positioned in relation to the suction head 16 and has a sensor 24, for example in the form of a specially designed photocell, which senses if one sheet, no sheet or a plurality of sheets is picked by the suction head 16. This sensing is performed for example in such a manner that the output signal generated by the photocell 24, which signal varies in level for each and every one of the aforesaid three cases, is compared in DMC-1 with a calibrated value corresponding to one sheet, and if more than one sheet is sensed a signal designated D (double) in FIG. 7 is generated and a lamp designated D in DMC-1 lights up. This indication means that more than one sheet has been picked. If, instead, a signal M (miss) is obtained and indicated on M in DMC-1, this lamp indicates a miss, i.e. no sheet at all.

The above sensing is used not only to indicate faulty picking but also to calibrate the picker so that it picks one sheet regardless of its thickness or weight. This calibration is performed by allowing DMC-1 for a certain sufficiently long time to sense a sheet in order to get a reference level corresponding to one sheet for the output signal from DMC-1, this signal being transmitted to CPU-1. The inserter is then started and commences picking, whereupon DMC-1 in the manner described above senses and transmits—if there is no sheet in the picker—a signal corresponding to a miss to a central processing unit CPU-1, which in turn instructs the air suction member 19 to increase its capacity. The suction 16 then picks yet another sheet and if DMC-1 now indicates and transmits a signal corresponding to normal the station is ready for commencement of operation. If, instead, DMC-1 indicates and still transmits a signal corresponding to a miss to CPU-1, CPU-1 orders the air suction member 19 to increase its capacity further, this being repeated until DMC-1 transmits to CPU-1 a signal corresponding to normal, i.e. one sheet. If, instead, DMC-1 indicates double, i.e. that more than one sheet has been picked, CPU-1 correspondly instructs the air suction member 19 to decrease its capacity for the next pick, this being repeated until DMC-1 transmits to CPU-1 a signal corresponding to normal, whereupon the station is ready for commencement of operation. This type of calibration is obviously usable for other types of machines than that described here, for instance for feeding of sheets into a printing press, a carton former or similar machines in which one and only one sheet is to be picked from a bundle. The same process as described above is carried out for each station in a picker which is described here.

Figure 6:
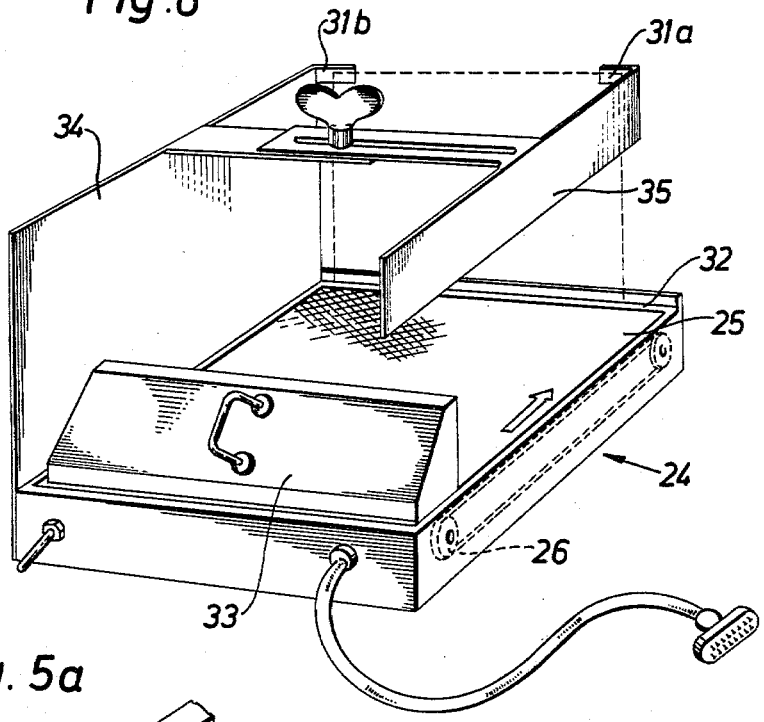
FIG. 6 shows a stacker for folded sheet material to be used, for example, in the embodiments shown in FIGS. 1 or 9.

The suction head 16 shown in FIG. 3 is also suitable for picking raised or erected sheets and also folded, raised sheets and a suitable device for stacking thereof is shown in FIG. 6. This device comprises an endless mat 25, which is driven by a motor 26 in the direction indicated by the arrow in FIG. 6. The folded and/or raised sheets on the mat 25 which are to be picked are placed against arresters 31*a*, 31*b* and against an edge 32. The sheets also rest against a wall 34 and an adjustably setable wall section 35. A support 33 with a certain weight serves to support the sheets. The sheets are thus raised on edge between 34 and 35 and the frontmost sheet rests against the arresters 31*a*, 31*b* and against the lower edge 32, other sheets being pressed down as the mat 25 moves forward in the direction indicated by the arrow. A suction head 16, largely constructed as shown in FIG. 3 but with the motor 13 activated so that the suction head 16 is positioned at a right angle to the position shown in FIG. 3, is made to approach the frontmost sheet in the device according to FIG. 6 and when the nozzles 15*a*–15*e* approach the said sheet and appropriately its lower part, the sheet adheres by suction to the suction head 16, whereupon the suction head 16 can be removed and thus pick the sheet, turning it in the wanted manner by activation of the motor 13 and depositing the sheet in the intended place. When the sheet has been removed in this way the bundle of raised sheets in the device moves forward in consequence of the travel of the mat 25. This device is particularly suitable for use in a hoist in the above-mentioned picking machine but can obviously also be used together with a suction head separate from the picking machine described here, for instance with an enveloping machine or an addressing machine.

DMC-1 in each station in each module receives and transmits all information to CPU-1 firstly in order to cope with the above-described calibration and adjustment. It also transmits information to CPU-1 in respect of quantity counting, bundle counting and counting of missed and double sheet, respectively. CPU-1 also gives orders—if so required—for bundling, stacking, picking and folding, etc.

The actual picking, inserting and depositing stages, respectively, do not per se comprise any direct innovative features of the present invention. For this reason no closer description of them is given in the present context, it sufficing simply to state that when a picking machine according to this invention is to be arranged, a plurality of modules, the number of which corresponds to half the number of sheets to be picked, are placed side by side and interconnected mechanically in the above described manner, all DMC-1 units being then connected electrically to CPU-1, which in turn is connected electrically with and controls all drive motors in the modules.

In order to increase the picking speed of the inserter disclosed and also in order to reduce the risk of picking several material sheets at a time it has also been found appropriate in accordance with one modified embodiment of the present invention to divide the desired material movement into (a) a lifting motion and (b) a transport motion.

According to the modified embodiment of the present invention, the above has been achieved in that the inserter is equipped with at least one suction-head-equipped prelifter which is arranged to pick one material at a time from the material bundle and to move this latter material to a level at which the reciprocatingly movable suction head works.

In order to be able to handle both vertically and horizontally positioned sheets it is necessary according to a further improvement for the prelifter to be made so as to be removable. In order to assure effective transfer of sheet material from one suction head to another it is also appropriate for the suction head of the prelifter and the reciprocatingly movable suction head to be arranged by means of a resetable valve to eject a transient air surge when the material is to be released from the respective suction head.

Figures 9, 11:
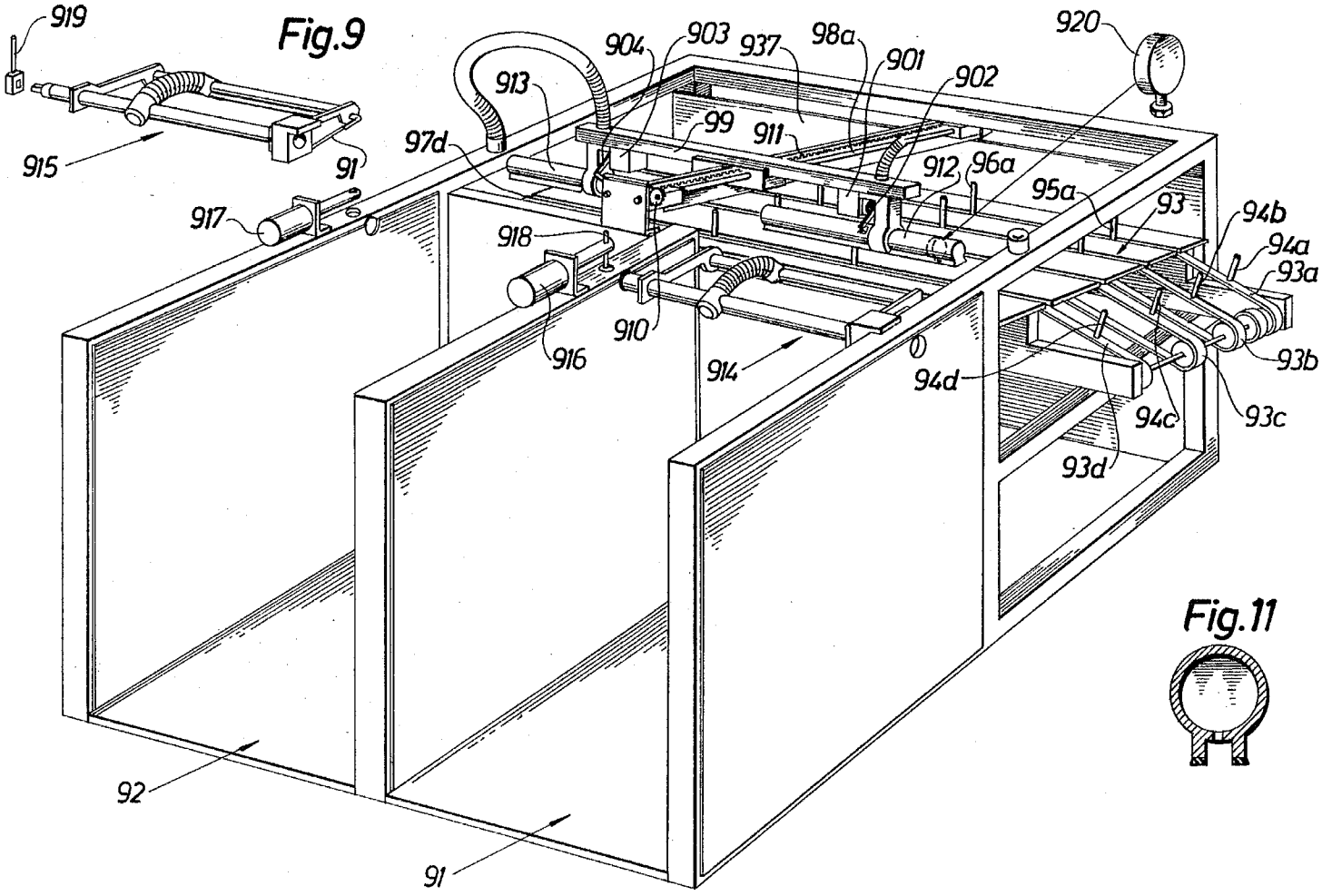
FIG. 9 shows a module with removable prelifters, which module is modified compared with that of FIG. 1.
FIG. 11 shows a sectional view through one suction head.
Figure 10:
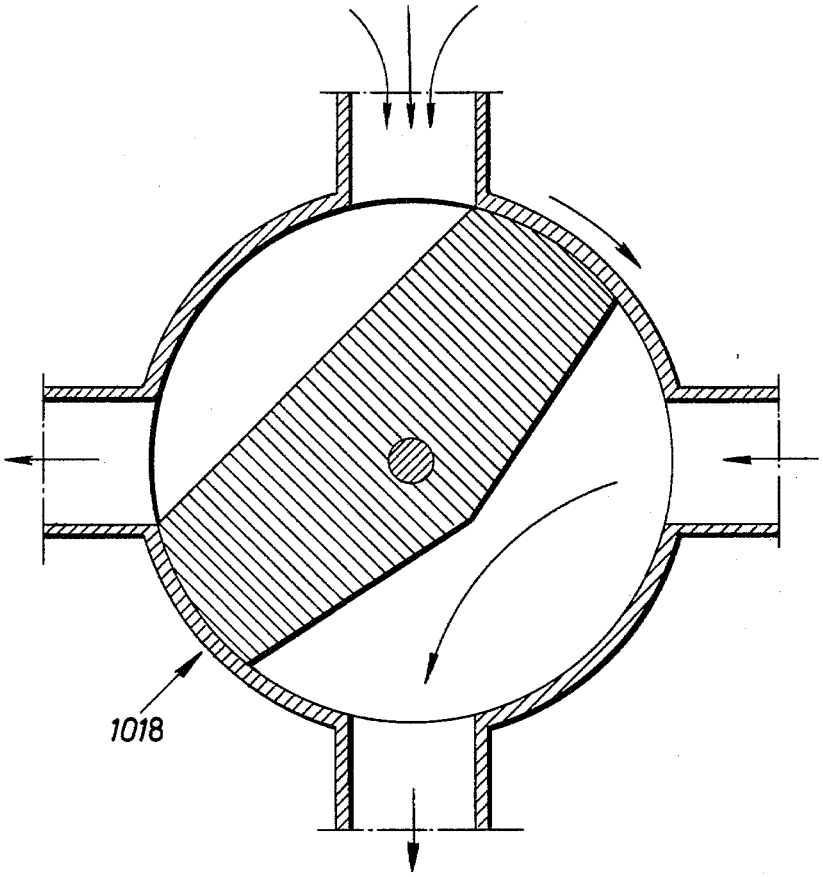
FIG. 10 shows one part of a motor-driven flap valve used in the modified module of FIG. 9

For a detailed description reference is made to FIGS. 9, 10 and 11, respectively.

The picking machine for sheeted material described hereinafter is in principle in agreement with that shown in FIGS. 1 to 8 and comprises an arbitrary number of easily assembled and connectable modules, each of which is entirely self-supplying. Each module is controlled by a central processing unit CPU-1 and by a microprocessor DMC-1 for each station in the module. DMC-1 in each station comprises the actual core of the picking machine but is described previously.

Referring to FIG. 9, each module includes two hoists 91, 92 into which bundles, for instance of paper sheets, are to be placed and from which bundles one sheet at a time is to be picked and deposited on a conveyor 93 running along one side of the hoists. The conveyor comprises a plurality of mutually parallel-running belts 93*a* to 93*d*, which are provided with drives 94*a*, 94*b* etc. that are aligned relative to each other. The transport surface of the conveyor is inclined slightly away from the hoists. The belts have furthermore been given such a direction of rotation that the direction of rotation of each belt deviates slightly from the wanted direction of transport for the sheets. The purpose of this is, in the first instance, for the sheets to be directed to the side of the conveyor located farthest away from the hoists in order thus to align one side of the sheets in relation to one another. The said side 937 of the conveyor is appropriately so devised that when several sheets are piled on top of one another the corresponding edge of the uppermost sheet is directed downwards, thereby preventing the edges from being folded upwards. The conveyor belts appropriately comprise toothed belts, each and every one of which forms a closed loop, are which are driven synchronously and preferably stepwise by a motor (not shown) located in one end of the module. The shaft which links the motor with drive wheels to the belts is preferably made openable at some point to allow the conveyor of an adjacent module to be interconnected with the conveyor in the first-mentioned module, thereby assuring synchronous operation of the module conveyors. Synchronization of the conveyors in the various modules can naturally be attained by some other means, for example by controlling the feed to the motors for the different conveyors in the modules.

Each module is provided in its front end—viewed in the direction of transport—with a plurality of recesses as shown in FIG. 2, the locations and quantity of these recesses corresponding to the quantity of the conveyor belts outside the other end of the module, thereby making it possible to allow the conveyor belts of two adjacent modules to run mutually parallel a short distance into the adjacent—viewed in the direction of transport—module and also enabling two modules and their conveyors to be interconnected mechanically as stated earlier. Also other control devices for example in the form of pins on one side of the module and corresponding recesses in its other side (see FIG. 2) permit reliable interconnection of adjacently disposed modules. It is essential for those parts of the belts which run outside a module to be directed downwards, i.e. to dive,—as shown in the right part of the module in FIG. 9—in order to attain smooth transfer of the sheets to the next module.

Each hoist is equipped with a separate motor—not shown—for individual drive of each hoist. Each motor drives a toothed wheel (not shown) which in turn drives an endless loop, as indicated in FIG. 1. Each hoist is naturally also equipped with devices (not shown) to stop it in the correct position. In the side of the hoists which is located closest to the conveyor there are also a number of slots, designated blow holes,—as shown in FIG. 1—the purpose of which will be explained in greater detail below.

Two guide rails 98*a*, 98*b* (not shown) in each module run over part of the hoists 91, 92 and out over the conveyor, which guide rails can in one or both ends be provided with a shock-absorbing device which can be designed as a bellows which emerges in the above-mentioned blow holes. Instead, a separate high-speed pump can obviously achieve the required blowing—airing—of the sheets in the hoists. A beam 99 running perpendicular to and controlled by the guide rails 98*a*, 98*b* can be driven by for example a tooth belt 911 driven by a motor 910. The beam 99 is equipped with a suction head 912 and 913, respectively, for each hoist, i.e. it has one suction head on each side of the guide rails 98*a*, 98*b*.

Each hoist 91 and 92, respectively, in each module is provided with a prelifter 914 and 915, respectively, each prelifter being arranged to be removable—as shown to the left in FIG. 9—or possibly so that it can be moved aside—not shown—in order to enable raised sheets, for example folded sheets, to be picked from the sheet bundles carried in the hoists. These prelifters are appropriately designed with the same type of adjustable suction ramp as the suction heads achieving the reciprocating motion.

A particularly simple and appropriate embodiment, shown in FIG. 9, is if the prelifters are turned by means of a motor 916 or 917 and a lever 918 or 917 from a lower position, in which a sheet material is picked, to an upper position, in which the transport suction head 912 or 913 takes over the largely horizontal transport of the sheet material to the conveyor 93 while retaining a largely horizontal position on the part of the suction head. This is achieved with the aid of a lever 91.

When the material sheet is being transferred from the prelifter 914 or 915 to the transport suction head 912 or 913 it is appropriate for the prelifter to emit en ejecting air surge at the same time as the transport suction head takes hold of the sheet by suction. Additionally, it is appropriate if also the transport suction head 912 or 913 upon completion of its forward movement emits an ejecting air surge so as to deposit the sheet material on the conveyor.

These transient air surge may be attained with the air of a motor-driven flap valve 1018 shown in FIG. 10.

Each suction head 912 or 913 is suspension-mounted and is turnable around its central shaft with the aid of a motor 901 or 903 with appurtenant levers 902 or 904, whereupon the turning of the suction head is always performed at the same level, i.e. no movement of the suction head relative to the picked paper sheets occurs, thereby avoiding the risk of smudging newly printed text.

The suction heads 912, 913 are—as evident from FIGS. 9 and 11—designed in this case as suction ramps with an adjustable stop 920, thereby facilitating setting of the size of the sheets to be picked and transported.

I claim:

1. Conveyor module for interconnection with identical modules for transport and registration of non-rigid sheet-like material, which sheet-like material during transport is placed on top of one another, comprising:

means defining a conveyor;

a control device arranged to control movement of and to register the sheet-like material which is to be transported by the conveyor in a desired direction of transport;

at least one elongated belt-like driving means (3) for driving said non-rigid sheet-like material along said conveyor;

said conveyor including a substantially flat surface (36) below which said belt-like driving means (3) runs;

a motor (10) coupled to said at least one belt-like driving means for driving same;

the direction of travel of said belt-like driving means being placed at a sharp angle in relation to said control device (37);

said control device including a side wall (37) extending upwardly from the vertical level of said belt-like driving means, said side wall (37) forming a second sharp angle to said substantially flat surface (36);

said at least one belt-like driving means comprising a plurality of separated upstanding drivers (94*a*, 95*a*, 96*a*) moved by said belt-like driving means in the same direction of travel as said belt-like driving means, said drivers protruding above said substantially flat surface (36) to abut and move said sheet-like material along the conveyor with force components directed parallel to said side wall (37) and directed toward said side wall (37), said parallel force being substantially greater than said perpendicular force; and said conveyor modules each including engagement means at respective opposite ends thereof for engagement and cooperation with another identical conveyor module located adjacent thereto and to align the conveying paths of adjacent identical conveyor modules;

said belt-like driving means protruding at one end of the conveyor module beyond the end of said substantially flat surface (36) so as to be received by an adjacent conveyor module, the direction of travel of the protruding part of said belt-like driving means deviating in a vertical direction from the direction in which it travels when running along said substantially flat surface (37) so as to provide clearance for a driving means of the adjacent conveyor module.

2. Conveyor module according to claim 1 wherein said substantially flat surface (36) is provided with at least one recess (27) at the other end of the module which is opposite the end from which said belt-like driving means protrudes, the extent of said recess corresponding to the length of the protruding portion of said belt-like driving means beyond the end of said substantially flat surface (36).

3. Conveyor module according to claim 1 or 2 wherein said belt-like driving means is provided with teeth for its propulsion.

4. Conveyor module according to claim 1 or 2, wherein said at least one belt-like driving means comprises a plurality of parallel-running belts each provided with teeth for propulsion and with said drivers.

5. Conveyor module according to claim 1 or 2, wherein said engagement means comprises guide pins at one end of the conveyor and corresponding recesses at the other end of the conveyor for mutual engagement and alignment of adjacently placed modules.

* * * * *